United States Patent [19]

Fitton

[11] 4,326,836

[45] Apr. 27, 1982

[54] SHROUD FOR A ROTOR BLADE

[75] Inventor: David L. Fitton, South Glastonbury, Conn.

[73] Assignee: United Technologies Corporation, Hartford, Conn.

[21] Appl. No.: 103,145

[22] Filed: Dec. 13, 1979

[51] Int. Cl.[3] ..... F01D 5/22

[52] U.S. Cl. ..... 416/196 R; 416/91

[58] Field of Search ..... 416/196 R, 190, 191

[56] References Cited

U.S. PATENT DOCUMENTS

| | | | |
|---|---|---|---|
| 2,877,980 | 3/1959 | Stalker | 416/196 R X |
| 2,952,442 | 9/1960 | Warnken | 416/190 |
| 2,999,631 | 9/1961 | Wollmershauser | 416/191 |
| 3,095,138 | 6/1963 | Warnken | 416/190 |
| 3,307,775 | 3/1967 | Petrie | 416/196 X |
| 3,327,995 | 6/1967 | Blackhurst et al. | 416/196 R |
| 3,352,538 | 11/1967 | Wilkinson | 416/196 |
| 3,501,090 | 3/1970 | Stoffer et al. | 416/189 |
| 3,545,882 | 12/1970 | Williamson | 416/190 |
| 3,556,675 | 1/1971 | Howald et al. | 416/190 |
| 3,566,493 | 3/1971 | Poucher et al. | 416/233 X |
| 3,754,839 | 8/1973 | Bodman | 416/190 X |
| 3,771,922 | 11/1973 | Tracy | 416/196 |
| 3,871,791 | 3/1975 | Guy et al. | 416/196 X |
| 3,905,722 | 9/1975 | Guy et al. | 416/196 X |
| 4,076,.455 | 2/1978 | Stargardter | 416/191 |
| 4,177,013 | 12/1979 | Patterson et al. | 416/190 X |
| 4,243,360 | 1/1981 | Wright | 416/196 R |

FOREIGN PATENT DOCUMENTS

| | | | |
|---|---|---|---|
| 1426798 | 3/1969 | Fed. Rep. of Germany | 416/196 |
| 2711409 | 8/1978 | Fed. Rep. of Germany | 416/196 |
| 1252763 | 12/1960 | France | 416/190 |
| 835177 | 5/1960 | United Kingdom | 416/189 R |
| 876637 | 9/1961 | United Kingdom | 416/196 |

*Primary Examiner*—Everette A. Powell, Jr.
*Attorney, Agent, or Firm*—Gene D. Fleischhauer

[57] ABSTRACT

A rotor blade for a rotor assembly which has a laterally extending shroud is disclosed. Various construction details and design techniques for the shroud which reduce the weight of the blade and increase the cyclic fatigue life of both the rotor blade and an associated component are developed. The shroud of the rotor blade is contoured in the lateral direction for nearly uniform stress distribution.

6 Claims, 4 Drawing Figures

W
y=yn
48
b
l
ΔW
Δl
+X
y=y1
X=0
Tmax
Tmin
C
h
50
Txy1
F
46
32

SHROUD FOR A ROTOR BLADE

BACKGROUND OF THE INVENTION

1. Field of the Invention

This invention relates to gas turbine engines and more specifically to the blades of a rotor assembly of such a machine.

2. Description of the Prior Art

The rotor assembly of a gas turbine machine includes a rotor disk having an axis of rotation and a plurality of outwardly extending blades each disposed about a spanwisely extending axis. Each rotor blade has a root and an outwardly extending airfoil attached to the root. The disk is adapted to receive the root of the rotor blade.

In modern engines many rotor assemblies typically have shrouds extending between the airfoils of adjacent blades. Shrouds which extend laterally between adjacent rotor blades at some point between the tip of the rotor blade and the root of the rotor blade are called part span shrouds. Shrouds which extend laterally between the tips of adjacent rotor blades are called tip shrouds. An example of a tip shrouded blade is shown in U.S. Pat. No. 4,076,455 issued to Stargardter entitled, "Rotor Blade System For A Gas Turbine Engine". The shrouds are cantilevered from the suction side surface of each airfoil and from the pressure side surface of each airfoil. The shrouds of adjacent blades abut along a contact face. In other applications, part span shrouds may be used in combination with tip shrouds or may be used singularly.

In either case, the shrouds are valuable for several reasons. The shrouds tie together the blades in a row to allow every blade in the row to accept its share of mechanical loads which develop, for example, when the blades are struck by foreign objects. The shrouds control tip amplitude during flight conditions and reduce the tendency for blade deflection about the spanwise axis and minimize vibration of the rotor blades. Damping of the blade takes place through rubbing of the contact faces of adjacent shrouds. However, additional rotational loads are created by the added mass of the shrouds located near the tip and near the middle of the blade as compared with rotor blades having no shrouds. These rotational loads induce stresses at the shroud airfoil interface and the root slot interface of the rotor blade and the disk. These stresses in shrouded blades require more massive designs than non-shrouded blades of equivalent cyclic fatigue life. Accordingly, scientists and engineers are working to provide shrouded rotor blades having reduced mass as compared with conventionally shrouded rotor blades such that the rotor blade has an improved cyclic fatigue life.

SUMMARY OF THE INVENTION

A primary object of the present invention is to increase the fatigue life of a rotor blade. Another object is to reduce the weight of a shroud attached to the airfoil. Still another object is to more fully utilize the capacity of the shroud material to resist the maximum fiber unit stresses in the shroud. In one embodiment, an object is to provide an aerodynamically smooth shroud.

According to the present invention, a shroud of a rotor blade extends from the airfoil in a lateral direction and is contoured in the lateral direction to provide a nearly uniform distribution of the maximum fiber unit stresses in the shroud.

A primary feature of the present invention is the geometric contour of the shroud. The shroud has a laterally outward portion and a laterally inward portion which joins the outward portion to the airfoil. The outward portion has a contact surface. The inward portion is generally tapered in cross section toward the outward portion.

A principal advantage of the present invention is the cyclic fatigue life which results from the decreased rotational loads experienced by the rotor blade. The decreased rotational loads result from the reduced weight of the shroud attached to the airfoil as compared with a conventional shroud. The reduced weight of the shroud results from the lateral contouring of the inner portion of the shroud. In one embodiment, aerodynamic smoothness is provided by a contoured filler material of lower density than the shroud material which forms the overall geometry.

The foregoing and other objects, features and advantages of the present invention will become more apparent in the light of the following detailed description of preferred embodiments thereof as discussed and illustrated in the accompanying drawing.

DETAILED DESCRIPTION

Figure 1:
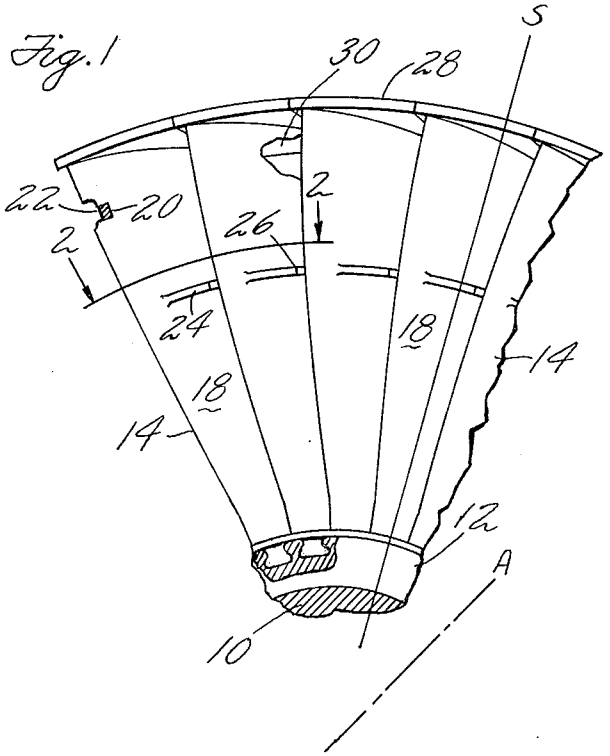
FIG. 1 is a simplified, front elevation view of a portion of a rotor assembly with parts of the rotor assembly broken away.

FIG. 1 is a simplified front elevation view of a rotor assembly 10 having an axis of rotation A in a gas turbine engine. The rotor assembly includes a disk 12 and a plurality of outwardly extending rotor blades 14. Each rotor blade has a root 16 and an airfoil 18 disposed about a spanwisely extending axis S. The airfoil has a suction side wall 20 and a pressure side wall 22. The airfoil has one or more interblade shrouds as represented by the part span shroud 24 extending laterally from the suction side wall of the airfoil and the part span shroud 26 extending laterally from the pressure side wall of the airfoil. The airfoil illustrated also has one or more interblade shrouds, as represented by the tip shroud 28 extending laterally from the suction side wall of the airfoil and the tip shroud 30 extending laterally from the pressure side wall of the airfoil.

Figure 2:
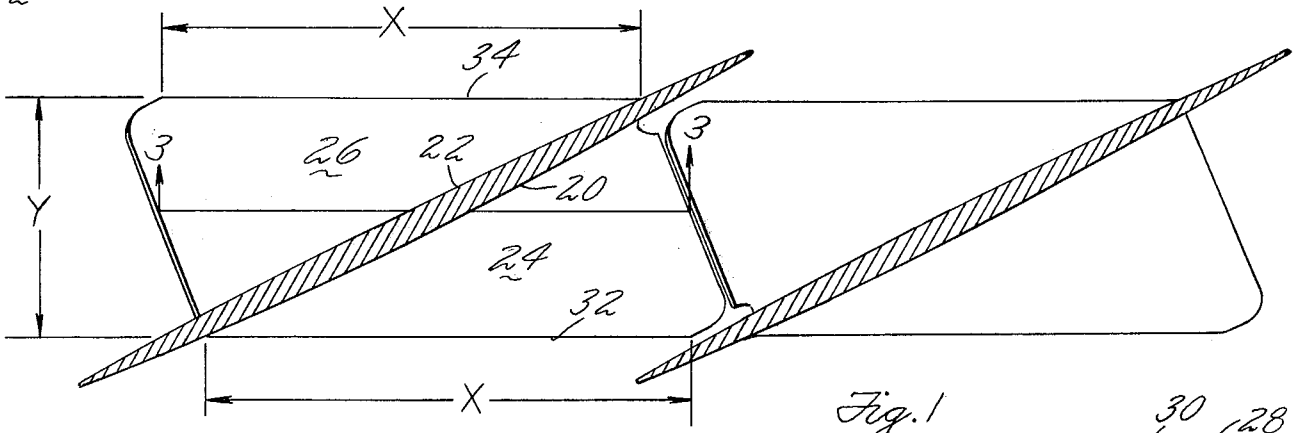
FIG. 2 is a sectional view of two rotor blades taken along the line 2—2 as shown in FIG. 1.

As shown in FIG. 2 each shroud has a laterally extending edge, as represented by either the front edge 32 of part span shroud 24 or the rear edge 34 of part span shroud 26. The rear edge is parallel to and spaced a distance Y from the front edge. The front edge and the rear edge extend a distance X.

Figure 3:
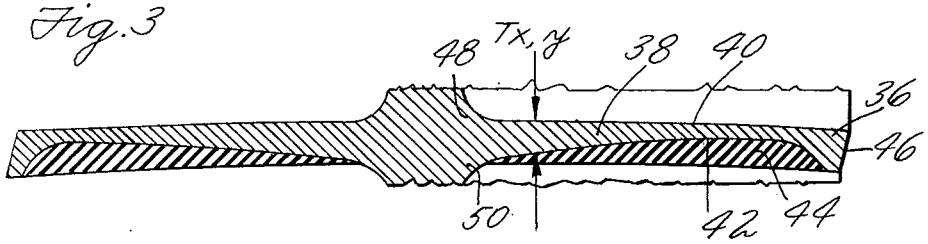
FIG. 3 is a sectional view taken along the line 3—3 as shown in FIG. 2.

FIG. 3 is a section taken through the shrouds 24 and 26 along a plane containing a line parallel to one of the laterally extending edges and containing a line parallel to the spanwise axis S. Each shroud has a laterally outward portion 36 and a laterally inward portion 38. The laterally inward portion extends between the outward portion of each shroud and the airfoil 18 and is integrally joined to both the airfoil and the outward portion. The shroud may be a one-piece construction or several pieces joined together.

Each shroud has an upper surface 40 and a lower surface 42. The lower surface is spaced from the upper surface by a distance having a magnitude $T_{x,y}$ at any point x,y on the shroud. The magnitude of the distance varies along the laterally extending section. A filler material 44 is attached to a surface of the shroud such as the lower surface to form an aerodynamically smooth profile. The filler material has a lower density than the shroud material. Effective structures are thought to result from the use of a lightweight aerospace alloy for the shroud such as Aerospace Material Specification (AMS) 4928 (Ti-6Al-4V) which has a density of 0.16 $lbm/in^3$ and a filler material of less density, such as epoxy foam, filled honeycomb or an organic polymer. One organic polymer suggested is RTV (Room Temperature Vulcanized) rubber having a density of 0.034 $lbm/in^3$.

Figure 4:
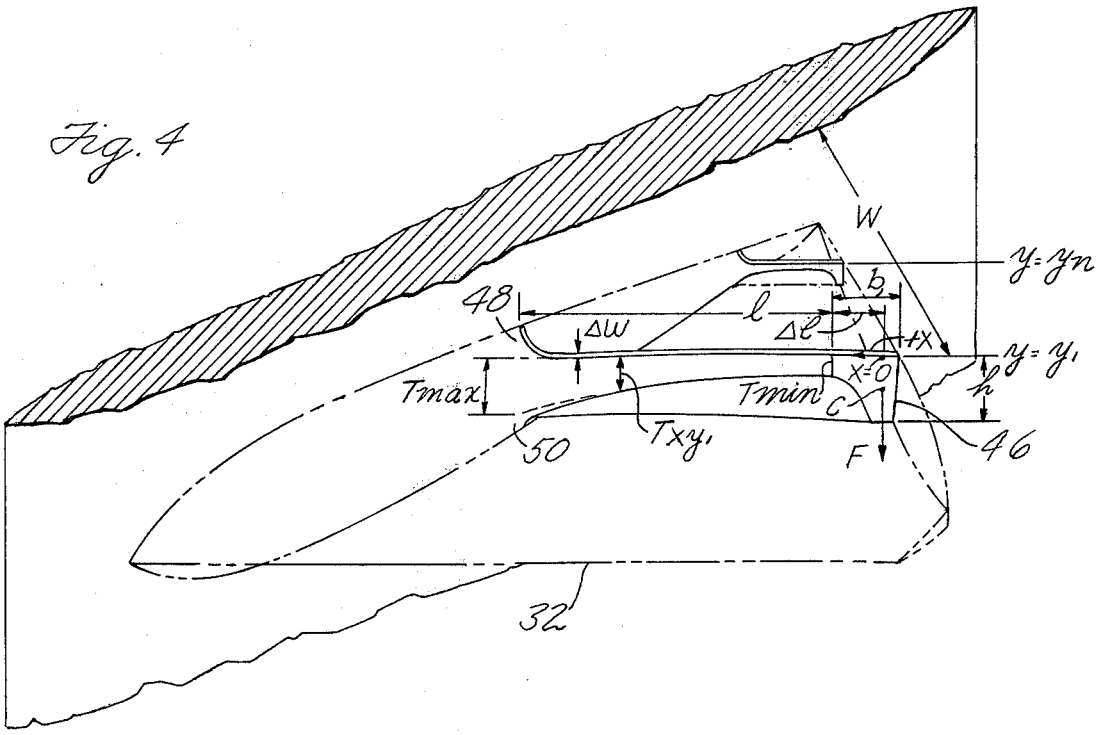
FIG. 4 is a perspective view of a part span shroud of one of the rotor blades with material removed to reveal two laterally extending sections of the shroud.

FIG. 4 shows the shroud 24 in phantom extending outwardly from the suction side wall 20. The shroud has a contact face 46 having a width W. The contact face has a height h at any point y.

FIG. 4 shows two shroud sections which are parallel to the laterally extending edge 32. The sections each have an infintesimal width $\Delta w$ for purposes of illustration. For clarity in showing the contour of the bottom surface and the contour of the top surface, the material between the sections and the filler material is not shown. In those designs not using filler material, the contours of the top surface and bottom surface of the shroud are easily seen without removal of any filler material.

The larger of the two sections shown in FIG. 4 corresponds to a portion of the section shown in FIG. 3. The plane along which this section is taken passes through the point $y=y_1$. An upper fillet 48 and a lower fillet 50 of shroud material extend between the suction side wall 20 and the inward portion 38 of the shroud. The inward portion 38 of the shroud has a length l. The outward portion 36 of the shroud has a laterally extending length b and a centroid C. The length from the centroid C to the outermost end of the inward portion is $\Delta l$. A force F associated with the mass of the outward portion acts through the point C. The thickness at any point $x,y_1$ along the inward portion of the shroud has a magnitude $T_{x,y1}$. At $x=\Delta l$, $T_{\Delta l,y1}$ is equal to a minimum, $T_{min}$. At $x=l+\Delta l$, $T_{l+\Delta l,y1}$ is a maximum, $T_{max}$.

During operation of a gas turbine engine, the rotor assembly rotates about the axis A. Each element of the rotor assembly has an associated mass and this mass causes forces to act on that element and on adjacent elements inducing stresses in the elements.

For the shrouds, the inward portion of each shroud, such as inward portion 38 of part span shroud 24, acts as a cantilever to support the outward portion 36 of the shroud and the filler material 44 from the airfoil. The inward portion resists the stresses caused by forces developed during rotation. The forces and the stresses are proportional to the mass of the inward portion, the mass of the filler material and the mass of the outward portion. The mass of the outward portion and the mass of the filler material associated with the outward portion act as a point loading passing through the centroid C at the point $(o,y_1)$.

The contour of the outward portion 36 determines the mass of the outward portion. The thickness $T_{x,y}$ and width W or chordwise dimension of the contact face of the outward portion are contoured according to proven airfoil designs to provide the outward portion with an optimum contour and a resultant mass.

The contour of the inward portion 38 of the shroud 24 determines the mass of the inward portion. This mass is one of the important factors in the design of the rotor blade. A large mass is not desirable and causes not only a correspondingly large weight for the blade 14 itself, but also enlarges the influence of the blade in associated components, such as the disk rim 12, loaded by the forces of rotation.

The inward portion 38 is contoured such that the selected maximum fiber unit stress in the operative environment has a suitable factor of safety and does not exceed the cyclic fatigue strength of the material from which the shroud is manufactured. In some cases the allowable maximum fiber unit stress is adjusted downwards to provide increased stiffness. With the above criteria in mind, the geometry of the inward portion is contoured to provide a maximum fiber unit stress at each point of thickness $T_{x,y}$ which is approximately equal to the maximum fiber unit stress at any other point in the inward portion of the shroud. To provide this contour, a laterally extending section passing through any point y, such as the laterally extending section illustrated in FIG. 3 and FIG. 4, passing through $y_1$, has a maximum thickness $T_{max}$ at the airfoil wall and a minimum thickness $T_{min}$ at the point $(x=\Delta l)$ where the inward portion joins the outward portion. $T_x$ increases in the outward portion and is equal to the height h of the shroud at the contact face which is the laterally outermost part of the outward portion. The length l of the inward portion and the length b of the outward portion of each section is selected according to proven airfoil designs and is a function of the aerodynamic and mechanical requirements which determine the circumferential spacing of the blades.

The laterally extending section of FIG. 3 as shown in FIG. 4, has the associated infinitesimal width $\Delta w$. The distribution of thickness is determined by the curve $T_x=f(x)$ for any such laterally extending section passing through a point y. Making the simplifying assumption for purposes of illustration that the masses act as a combination of pure end loading and pure uniform loading the equation for $T=f(x)$ is of second degree for the inward portion 38 of the shroud. For the inward portion of the shroud, $T_x=T_{l+\Delta l}=T_{max}$ at the suction side wall 20 of of the airfoil and $T_x=T_{\Delta l}=T_{min}$ at the laterally outermost extension of the inward portion. Between $T_{max}$ and $T_{min}$ the equation $T_x=f(x)$ is of second degree having the form $C_1T_x^2+C_2T_x+C_3X+C_4=0$. For pure end loading at any point x, the thickness $T_x$ equals $T_{max}$ multiplied by the square root of the quantity x divided by the summation of the length l of the inward portion and the length $\Delta l$ between the inward portion and the centroid C of the outward portion 36, $[T_x=T_{max}\cdot(x/l+\Delta l)^{\frac{1}{2}}]$. For pure uniform loading $T_x$ equals $T_{max}$ multiplied by the quantity x divided by the summation of the length l of the inward portion and the length $\Delta l$ between the inward portion and the centroid of the outward portion $[T_x=T_{max}\cdot(x/l+\Delta l)]$. The summation of the two equations is a second degree curve in $T_x$ and x and is parabolic in shape. The resulting curve is a thickness distribution. Applying the above thickness distribution to a part span shroud having an upper surface which is a circular arc, the curve of the inner surface along a laterally extending section tends toward a straight line with some small curvature at the outermost portion near the end which acts to reduce stress concentrations. Applying the same thickness distribution to a part span shroud having an upper surface which is planar, the curve of the inner surface along a laterally extending section is a second degree curve. In order to simplify fabrication the curve, for example, on the lower surface may be replaced by a straight line approximation. Sophisticated computing techniques and sophisticated fabrication techniques allow the surfaces to be made very accurately and enable constructions having a maximum unit fiber stress which is approximately equal to the maximum unit fiber stress at any other point in the inward portion of the shroud. Structures having less sophisticated geometry may nevertheless be effective where the maximum fiber unit stresses across the shroud are nearly uniform. It is expected that structures experiencing variations of no more than 20% in the maximum fiber unit stress will be effective.

Addition of filler material of less density than the shroud material to make the airfoil aerodynamically smooth increases the mass of the shroud and the stresses in the airfoil, the root, and the disk by an amount less than an airfoil having an equivalent aerodynamically smooth shape and made entirely of shroud material. In fact, any rotor assembly using a shroud having lateral sections which have a maximum fiber unit stress near the wall and a maximum thickness at the wall, a minimum thickness at the outermost part of the inward portion with approximately the same maximum fiber unit stress, a thickness distribution $T_x=f(x)$ which appears along each section from the maximum thickness to the minimum thickness and filler material added to form an aerodynamic contour will have an improved cyclic fatigue life as compared with shrouds having the same overall geometry and made entirely of shroud material.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of my invention, that which I claim as new and desire to secure by Letters Patent of the United States is:

1. For a rotor blade of the type used in gas turbine engines which has an airfoil disposed about a spanwisely extending axis and a shroud extending laterally from the airfoil, the improvement which comprises:

a shroud having a laterally outward portion having a contact surface which adapts the rotor blade to engage a contact surface on an adjacent shroud of an adjacent rotor blade in the installed condition in the engine, a laterally inward portion extending between and integrally joined to the laterally outward portion and the airfoil for providing support to the laterally outward portion;

wherein said inward portion of the shroud has a geometric contour, said geometric contour having dimensions that cause the inward portion of the shroud to exhibit a maximum fiber unit stress in a rotational force field that is nearly uniform throughout the lateral length of the inward portion of the shroud.

2. For a rotor blade of the type used in gas turbine engines which has an airfoil disposed about a spanwisely extending axis and a shroud extending laterally from the airfoil, the improvement which comprises:

a shroud having a laterally outward portion having a contact surface which adapts the rotor blade to engage a contact surface on an adjacent shroud of an adjacent rotor blade in the installed condition in a gas turbine engine, a laterally inward portion extending between and integrally joined to the laterally outward portion and the airfoil for providing support to the laterally outward portion and having a laterally extending edge;

wherein said inward portion of the shroud has a geometric contour such that, at any section taken through the shroud along a plane containing a line parallel to the edge and containing a line parallel to the spanwisely extending axis, said section has a maximum thickness at the airfoil, a minimum thickness at the outermost end of the laterally inward portion and said section tapers from the maximum thickness to the minimum thickness; wherein a filler material of less density than the shroud material is attached to the airfoil for aerodynamic smoothness; and wherein the said geometric contour has dimensions that cause the maximum fiber unit stress at the point of maximum thickness in a rotational force field to be approximately equal to to the maximum fiber unit stress at the point of minimum thickness.

3. The invention as claimed in claim 1 wherein the shroud further has a laterally extending edge, an upper surface, and a lower surface spaced a distance $T_{x,y}$ from the upper surface;

wherein $T_{x,y1}$ is in a section taken through the shroud along a plane containing a line parallel to said edge, containing a line parallel to the spanwise axis and passing through a point $y_1$ and $T_{x,y1}$ has a magnitude $T_{x1y1}$ at a first location, and a magnitude $T_{x2y1}$ at a second location, the second location being laterally further away from the airfoil than the first location, the ratio $T_{x2y1}$ to $T_{x1y1}$ being less than one or equal to one in the support portion $$\left(\frac{T_{x2y1}}{T_{x1y1}} \leqq 1.0\right)$$

and the ratio of $T_{x2y1}$ to $T_{x,y1}$ being greater than one or equal to one in the contact portion $$\left(\frac{T_{x2y1}}{T_{x1y1}} \geqq 1.0\right).$$

4. The invention according to claim 3 wherein a substantial part of the lower surface of the inward portion of the shroud in said section is linear.

5. The invention according to claim 3 wherein a substantial part of the lower surface of the inward portion of the shroud in said section is a curve which is defined by a second degree equation.

6. The invention according in the alternative to claim 1, claim 3, claim 4 or claim 5, wherein a filler material having a smaller density than the shroud material is joined to the shroud material for aerodynamic contouring.

* * * * *